US005127417A

United States Patent [19]

Tromblee et al.

[11] Patent Number: 5,127,417

[45] Date of Patent: Jul. 7, 1992

[54] SOIL SEPARATOR FOR A DISHWASHER

[75] Inventors: Jon D. Tromblee, Hagar Township, Berrien County; Vincent P. Gurubatham, St. Joseph; Edward C. Peterson, St. Joseph Township, Berrien County, all of Mich.

[73] Assignee: Whirlpool Corporation, Benton Harbor, Mich.

[21] Appl. No.: 635,775

[22] Filed: Dec. 28, 1990

[51] Int. Cl.[5] ..... B08B 3/02

[52] U.S. Cl. ..... 134/111; 134/155; 134/186

[58] Field of Search ..... 132/111, 109, 155, 186; 68/18 F, 208

[56] References Cited

U.S. PATENT DOCUMENTS

| | | | |
|---|---|---|---|
| 935,201 | 9/1909 | Hallauer . | |
| 1,123,260 | 1/1915 | Dusseau . | |
| 1,256,557 | 2/1918 | Heermans . | |
| 2,061,089 | 11/1936 | Rheinstrom . | |
| 2,139,096 | 12/1938 | Piquerez . | |
| 2,681,658 | 6/1954 | Meeker et al. . | |
| 2,742,381 | 4/1956 | Weiss et al. . | |
| 2,845,936 | 8/1958 | Boynton et al. . | |
| 2,862,510 | 12/1958 | Geiger et al. . | |
| 3,034,518 | 5/1962 | Butsch et al. . | |
| 3,084,701 | 4/1963 | Hardy et al. . | |
| 3,111,132 | 11/1963 | James . | |
| 3,122,148 | 2/1964 | Alabaster | 134/111 |
| 3,322,282 | 5/1967 | Lyman . | |
| 3,640,290 | 3/1972 | Angold | 99/408 |
| 3,669,132 | 6/1972 | Mamrose . | |
| 3,810,480 | 5/1974 | Smith et al. | 134/186 X |
| 4,150,679 | 4/1979 | Cushing et al. . | |
| 4,168,715 | 9/1974 | Spiegel et al. | 134/111 X |
| 4,168,715 | 9/1979 | Spiegel et al. . | |
| 4,319,599 | 3/1982 | Dingler et al. . | |
| 4,346,723 | 8/1982 | Geiger | 134/186 |
| 4,848,382 | 7/1989 | Bertsch et al. . | |
| 4,969,479 | 11/1990 | Lagerstrand | 134/111 |
| 4,998,548 | 3/1971 | Lagerstrand | 134/111 |

FOREIGN PATENT DOCUMENTS 917468 9/1954 Fed. Rep. of Germany .

*Primary Examiner*—Frankie L. Stinson

*Attorney, Agent, or Firm*—Hill, Van Santen, Steadman & Simpson

[57] ABSTRACT

A soil separator for a dishwasher is provided in which the recirculating wash liquid flow through the dishwasher is divided into two flow streams and the soil separator is positioned in one of the flow streams. A screen blocks passage of large soil particles and directs then into the flow stream leading to the soil separator. An elevated dam in the soil separator blocks passage of lighter-than-water particles and a weir blocks passage of heavier-than-water particles. A V-shaped notch in the weir permits flow from the soil separator to rejoin the other flow stream.

21 Claims, 4 Drawing Sheets

SOIL SEPARATOR FOR A DISHWASHER

BACKGROUND OF THE INVENTION

This invention relates to a separator device for separating heavier-than-water and lighter-than-water material from a flow of wash liquid, and more particularly to a soil separator for a dishwasher.

Soil separators in dishwashers are well-known. U.S. Pat. No. 3,322,282, assigned to the assignee of the present invention discloses a soil separator which allows soil-laden water to flow over a strainer to remove entrained particles. U.S. Pat. No. 4,848,382, assigned to the assignee of the present invention, discloses a soil separator permits soil-laden water to flow into a settling chamber where heavier particles are permitted to settle to the bottom. U.S. Pat. No. 3,669,132 discloses a soil separator which forces pressurized water through one or more filters to remove entrained particles. Soil separators, as shown in U.S. Pat. No. 1,256,557 are also known which block passage of floating particles.

The strainer or settling type soil separators are capable of removing large or heavier-than-water particles, while filters effectively remove heavier-than-water and lighter-than-water particles which are larger than the filter mesh.

SUMMARY OF THE INVENTION

The present invention provides an improved soil separator for a dishwasher. An object of the invention is to provide a system for removing soil from the recirculating spray water in a dishwasher. A further object of the invention is to reduce the amount of wasted water by recirculating water into the spray system. Yet a further object is to provide a soil separator that is inexpensive to manufacture and operate that nevertheless effectively removes both light and heavy soils of all sizes from circulation in a dishwasher.

The present invention utilizes a dual sump system in which one of the sumps is provided with a separator chamber for receiving heavily soil-laden wash liquid. Separate channels leading from the wash chamber are provided to divide the recirculating flow of wash liquid into two separate streams. The sump with the separator chamber receives a portion of the divided recirculating stream at a low flow rate therethrough of approximately one half gallon per minute. The second sump, being a spray sump, receives wash liquid directly from the wash cavity at a high flow rate of approximately nine gallons per minute which is then recirculated through a spray arm and into the wash cavity.

A removable screen covers the drain area leading into the spray sump. This screen prevents large soil particles from entering into the spray sump and directs those particles into the divided low flow rate stream flowing through the separator chamber since it is disposed at an angle on the floor of the dishwasher, pitched toward the separator chamber channel. The screen is kept clean by a combination of water flowing along the bottom of the wash cavity and from a downward-facing nozzle in the spray arm. This water flow naturally forces the soils down off of the screen and into the channel which communicates with the separator chamber.

The separator chamber includes a baffle for reducing turbulence in the flow stream, an elevated dam which permits water to only flow thereunder, and a weir with a V-shaped notch in it communicating with the spray sump. As mentioned, the baffle reduces the turbulence of the water flowing through the separation chamber allowing lighter-than-water particles to float and heavier-than-water particles to sink. The dam captures the lighter-than-water particles and prevents them from flowing toward the weir, and the V-shaped notch in the weir is positioned high enough to prevent heavier-than-water particles from flowing through it.

By use of such a soil separator, soils are quickly removed from the recirculating wash liquid, permitting water to be readmitted to the spray sump for recirculation and further soil removal from the articles within the dishwasher. This permits a conservation of water.

The weir with the V-shaped notch in it allows the flow rate from the separator chamber to the spray sump to self-adjust based upon the flow rate into the separator chamber.

DESCRIPTION OF THE PREFERRED EMBODIMENTS

Figure 1:
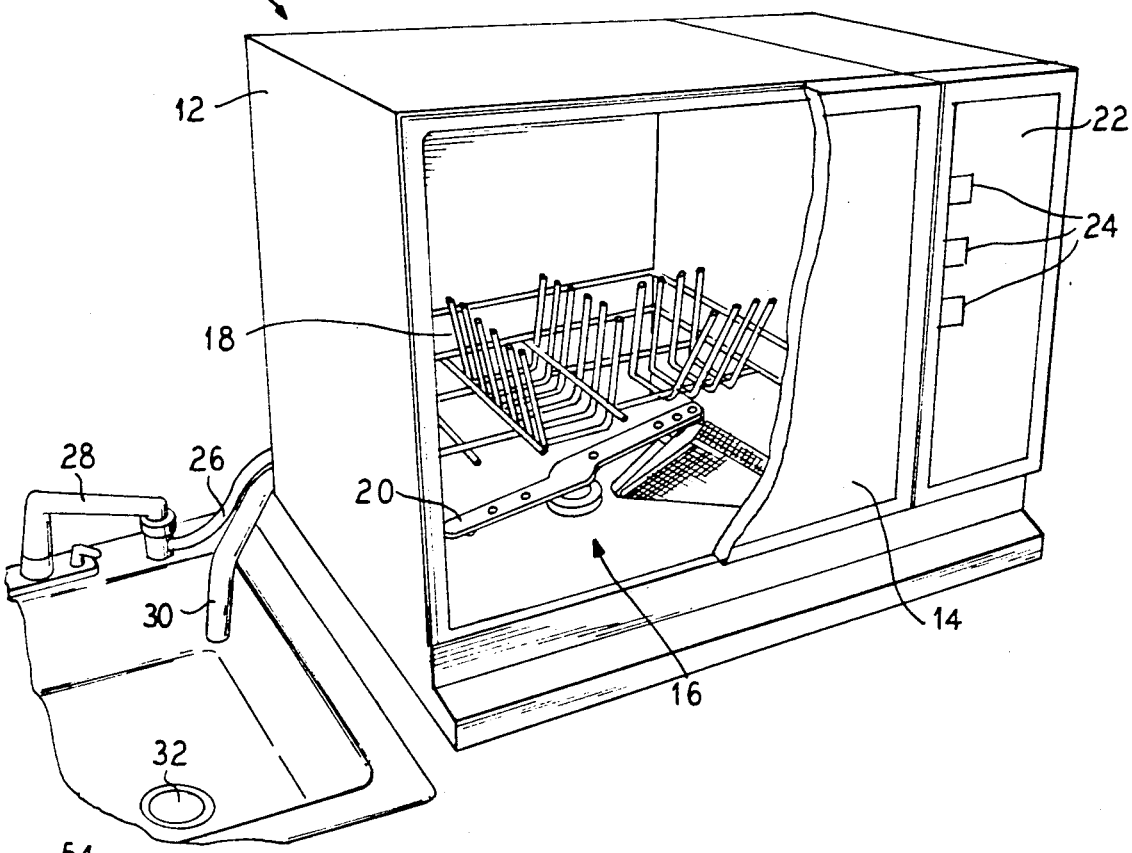
FIG. 1 is a perspective view of an automatic dishwasher incorporating the principles of the present invention.

FIG. 1 shows a dishwasher 10 having a cabinet 12 and an openable door 14. A wash chamber 16 of the cabinet 12 houses dish supporting racks 18 and a rotating spray arm 20.

A control panel 22 is provided with a plurality of controls 24 for pre-selecting the desired cycle of operation for the dishwasher.

Since the dishwasher 10 embodying the principles of the present invention may be a countertop style dishwasher, a water inlet hose 26 is shown as being connected to a kitchen faucet 28 and a drain hose 30 is shown as being directed toward a kitchen sink drain 32. Of course, the dishwasher 10 could be a built-in unit, in which case the water inlet line 26 and the drain line 30 would be permanently connected to the house plumbing.

As seen in FIG. 1, there is a dish rack 18 provided in the dishwasher. The rack may be provided with rollers 33 (FIGS. 5 and 6) for easy movement of the rack.

Preferably, the rack is formed of welded wire with a plastic coating. The wire form of the dish rack is designed so as to minimize interference of the rack with spray from the spray arm 20.

Figure 2:
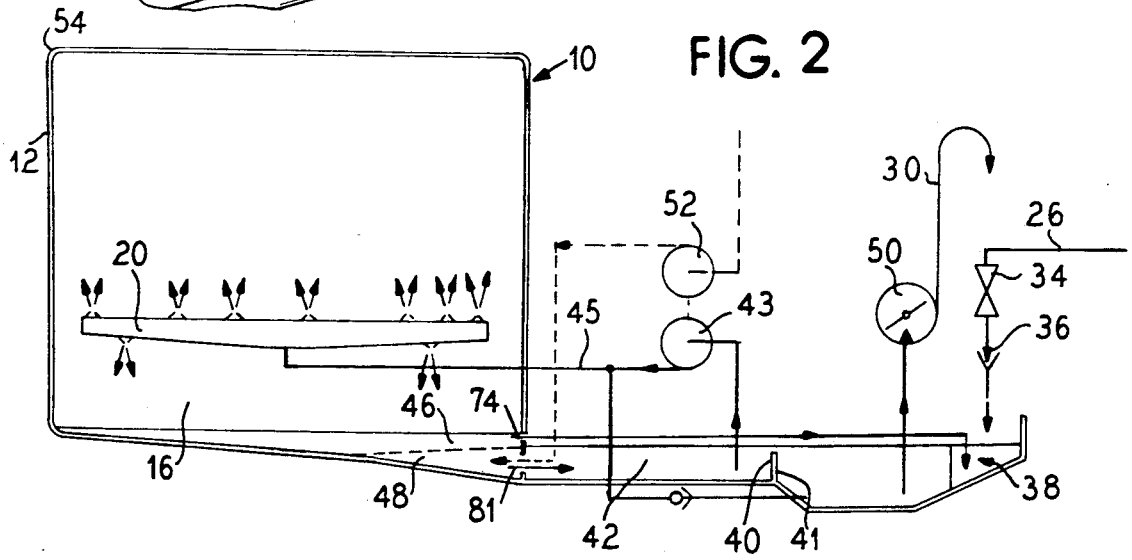
FIG. 2 is a schematic illustration of the fluid flow patterns through the dishwasher of FIG. 1.

FIG. 2 shows a schematic illustration of the fluid flow patterns within the dishwasher 10. In the schematic illustration the water inlet line 26 is shown at the far right, where it is seen that water first passes through a fill valve 34 which is operated by the dishwasher control 24. The inlet water then passes through a vacuum break 36 and into a settling chamber/drain sump 38. From the settling chamber/drain sump 38, water flows through an opening 40 in a separating wall 41 into a spray sump 42. From the spray sump 42 water is drawn by a spray pump 43 driven by a motor 44 (FIG. 4) and directed to the spray arm 20 within the wash chamber 16 through a connecting conduit 45. Water from the wash chamber 16 partially flows to a first trough 46 through an opening 74 and into the settling chamber/drain sump 38 and partially to a second trough 48 through an opening 81 and back to the spray sump 42. At various times during the wash cycle, when it is desired that the wash liquid be removed from the dishwasher, a drain pump 50 driven by a motor 51 (FIG. 4) draws wash liquid from the settling chamber/-drain sump 38 and directs it to the drain line 30.

During a drying portion of the wash cycle, room air is drawn in by a blower or fan 52 operated by the spray pump motor 44. The air is directed in through the second trough 48 to flow through the wash chamber 16 to be vented through an opening 54 preferably located near the front top portion of the dishwasher cabinet 12.

Figure 3:
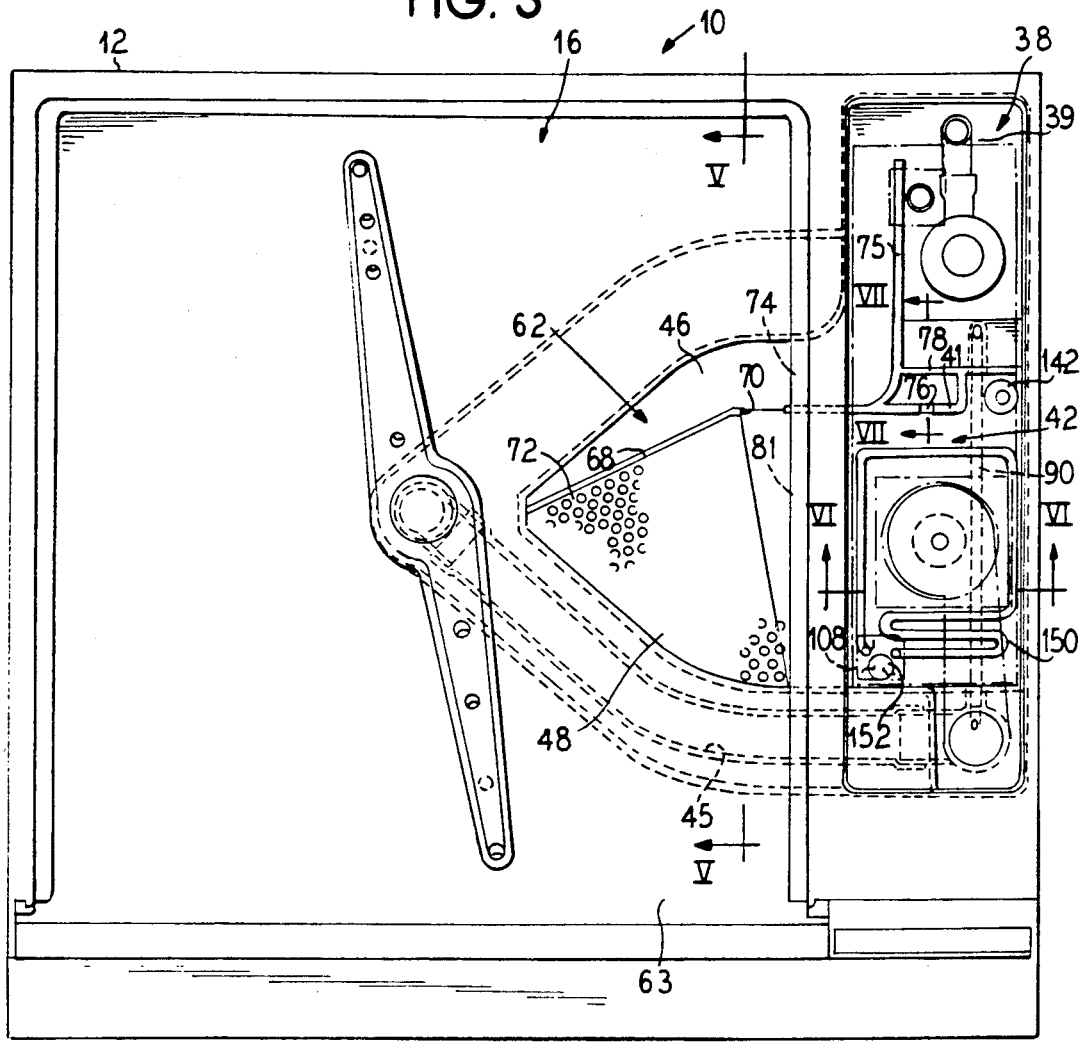
FIG. 3 is a plan or top view of the base portion of the dishwasher of FIG. 1.
Figure 5:
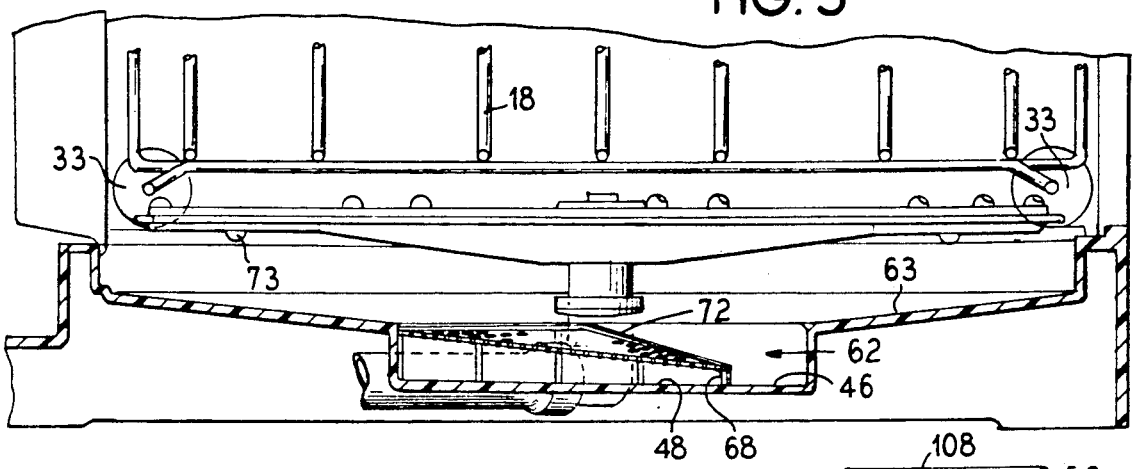
FIG. 5 is a side sectional view of the wash cavity and sump inlet areas taken generally along the line V—V of FIG. 3.
Figure 6:
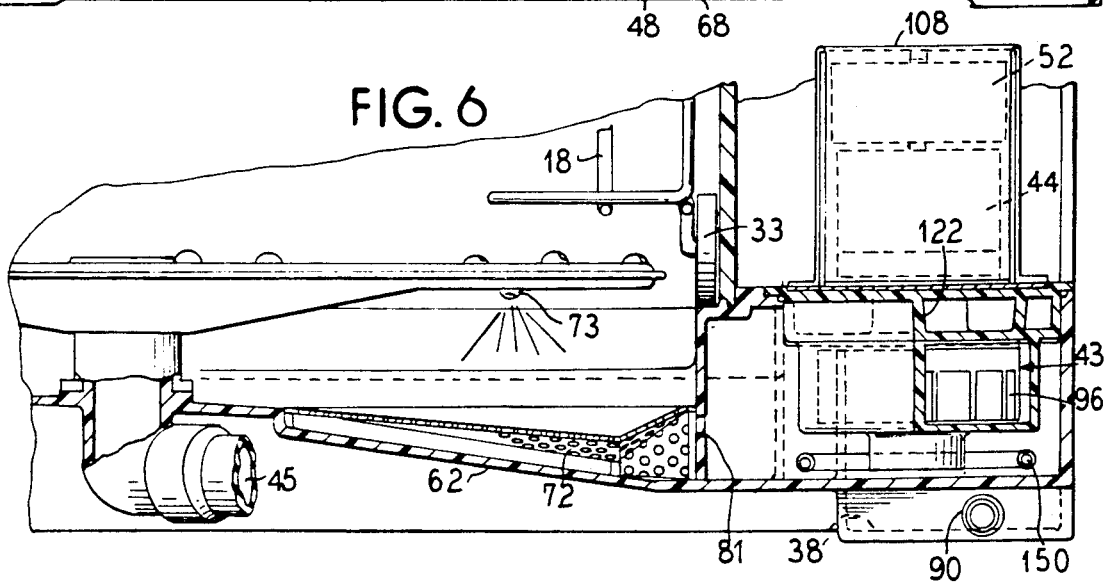
FIG. 6 is a side sectional view of the wash cavity and sump inlet areas taken generally along the line VI—VI of FIG. 3.

As best seen in FIGS. 3 and 5, wash liquid drains from the wash cavity 16 by means of a depressed area or sump 62 which preferably is molded into a bottom wall 63 of the wash chamber. The depressed area 62 is divided into the two troughs 46, 48 by a dividing wall 68 which extends along most, but not the entire length of the depressed area 62. There is a communicating opening 70 through the wall 68 between the two troughs 46, 48 which assists in the draining of the dishwasher. The two troughs are of unequal size, and the larger trough 48 leads to the spray sump 42, and is covered with a filter screen 72 which permits passage of liquid, but which inhibits passage of food particles.

The screen 72 is sloped downwardly toward the smaller trough 46, and thereby assists in the movement of soil particles toward the first trough.

Also, the spray arm 20 has at least one downwardly directed nozzle opening 73 which directs a spray of wash liquid against the screen 72 (FIG. 6) to assist in the cleaning of the screen and directing food particles to the first trough 46. Spray arm rotation is set so that the cleaning spray can sweep soil directly off of the filter screen 72 and into the first trough 46 leading to the settling chamber/drain sump 38. The first trough 46 leads to an opening 74 communicating with the settling chamber/drain sump 38 which is located at the lowest elevation of the dishwasher cabinet.

The settling chamber/drain sump 38 is crucial to the operation of the dishwasher, in that it enables the dishwasher to achieve an acceptable level of wash results with just four fills and one detergent addition. The settling chamber/drain sump 38 removes both lighter-than-water and heavier-than-water soils from the recirculating wash liquid. These soils are trapped in the settling chamber/drain sump 38, in which the drain pump 50 is located, so that they are disposed of quickly during the pump-out process. The settling chamber/-drain sump 38 includes an isolated chamber 39 to which soil-laden water is directed from the trough 46 in the dishwasher base unit. The entry opening 74 to the settling chamber/drain sump 38 has its top **74*a* above the operating wash liquid level. This allows floating soil to enter the chamber and prevents it from being trapped in the main washing compartment 16**.

Figure 7:
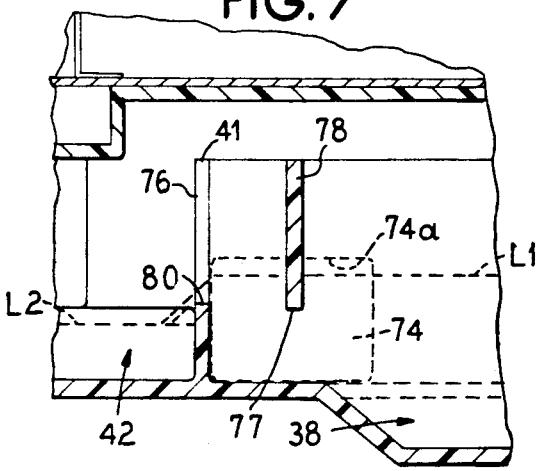
FIG. 7 is a side sectional view of the sumps separating wall taken generally along the line VII—VII of FIG. 3.
Figure 8:
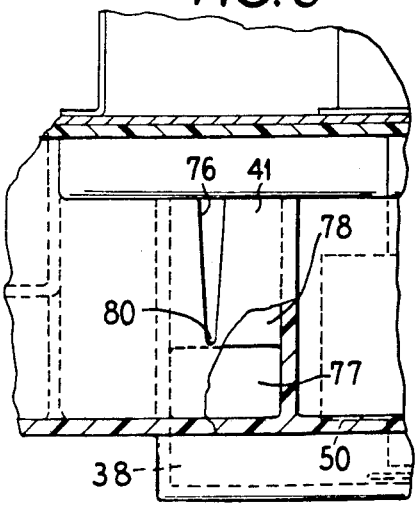
FIG. 8 is a side sectional view in the spray sump taken generally along the line VIII—VIII of FIG. 9.

The flow through the settling chamber/drain sump 38 is carefully controlled to reduce turbulence and allow soils to settle (or float) out of the wash/rinse fluid. Within the settling chamber/drain sump 38 there is a baffle wall 75 which prevents turbid fluid from the wash chamber 16 from flowing directly into the isolated chamber 39. During the wash cycle, as fluid flows through the trough 46 into the settling chamber/drain sump 38, it is permitted to flow then into the spray sump 42 through the opening 76, which is in the form of a V-shaped notch (FIGS. 3,7 and 8) formed in the wall 41 that isolates the settling chamber/drain sump from the spray sump.

The V-notch 76 is sized so that a flow rate of approximately one half gallon per minute is maintained through the V-notch when the spray pump 43 is operating. The flow of wash liquid from the settling chamber/drain sump 38 to the spray sump 42 is directed through an opening 77 (FIGS. 7,8) under an appropriately spaced wall 78 so that floating soil is trapped in the settling chamber/spray sump before it gets to the V-notch 40. A bottom 80 of the V-notch 40 is high enough to trap heavy soil that has settled to the bottom of the isolated chamber 39. The flow velocity through the settling chamber/drain sump 38 is normally relatively slow, thus allowing heavier-than-water soils to settle, and lighter-than-water soils to rise.

The screen 72 provides a small impedance of the flow of wash liquid from the wash cavity sump 62, through an opening 81 communicating with the spray sump 42. This impedance produces a wash liquid level that is higher in the settling chamber/drain sump 38 than the level in the spray sump 42, and provides the driving force that gives the above-mentioned one half gallon per minute separator flow.

The system described is self-regulating. In the exemplary embodiment, the settling chamber/drain sump 38 is designed for a one half gallon per minute flow of relatively clean wash liquid. When heavy soils are encountered, the protecting filter screen 72 may become partially blocked. This increases the flow impedance to the spray pump 43 and creates a greater fluid level difference between the spray sump 42 and the isolated chamber 39 of the settling chamber/drain sump 38. As the fluid level in the spray sump 42 drops, the effective fluid passage area through the V-notch 40 increases. The result is that the fluid flow rate through the V-notch 40 increases until the heavy soil is pulled from the surface of the screen 72 and into the settling chamber/-drain sump.

As a result, the filter screen blockage has been eliminated, flow impedance is returned to normal, and then flow through the settling chamber/drain sump returns to the one-half gallon per minute rate. The result is very rapid removal of large soil particles from the wash water followed by removal of the fine soil particles. The slow relatively turbulence-free flow through the settling chamber/drain sump 38 also minimizes the suspension and homogenizing action that occur between detergent and soil in a highly agitated system. The result is that little detergent is used by the soil trapped in the settling chamber/drain sump 38. This means that more detergent remains available in the water for cleaning of the dishes, or, alternatively, less detergent addition is needed to perform the cleaning function.

At appropriate times during the wash cycle the wash liquid within the dishwasher is pumped by drain pump 50 through the drain line 30 to remove wash liquid and collected soil particles from the dishwasher. A soil chopper 82 (FIG. 4), including a single wire pressed at a right angle through an extension 84 of the pump impeller, is located just below an impeller opening 86 of the drain pump 50. The proximity of the chopper 82 to the impeller opening 86 is chosen such that the chopper 82 chops all soil to a size that can pass through both the pump 50 and the drain hose 30 of the system. A pump capacity of approximately one gallon per minute has been determined to be sufficiently large to provide the necessary pump out operation.

A separate drain line 90 (FIG. 4) is provided between the spray conduit 45 and the drain pump 50 to permit a pump out of all wash liquid within the system. The drain line 90 includes a check valve 92 which is closed when the spray pump 43 is in operation, but which moves to an open position, allowing draining to the settling chamber/drain sump 38, when the spray pump 43 is not in operation.

Both the spray pump 43 and drain pump 50 of the power system are designed to operate without pump seals. This is facilitated by the fact that both of the motors are well above the operating wash liquid level. To facilitate the no-seal design, impellers 94, 96 of the pumps 50, 43 have pumping elements or impeller blades 98, 100 on both sides. The pumping element 100 on the motor side of the impeller counteracts the pressure developed by the main impeller pumping element 98. This prevents pressurized water from escaping through a clearance space 102 between a motor shaft 104 and the pump body 106. This design eliminates both manufacturing and service costs associated with pump seals. It also allows the pumps to be run "dry" with no chance for seal damage.

Since running dry is possible, the spray pump motor 44 is fitted with the fan 52 that serves both to cool the motor and to provide forced air for drying within the dishwasher. A cover 108 is provided which surrounds the motors 44, 51 and fan 52, and which is secured to a subassembly base 110 carrying the motors 44, 51 by an appropriate fastener arrangement such as a tab in groove connection 112 at one end 114 and a wire rod clip 116 secured between the cover 108 and the dishwasher base 118 at an opposite end 120.

The subassembly base 110 has a passage 122 molded therein which permits air from outside the cover 108 to be drawn into an area 124 enclosed by the cover 108. More particularly, the air is drawn through the passage 122 into openings 126 which are within a separate cover 128 enclosing the motor 44. The air is then drawn through an opening 130 in the motor cover 128 into the fan 52 which then pressurizes the area 124 within the cover 108.

Figure 9:
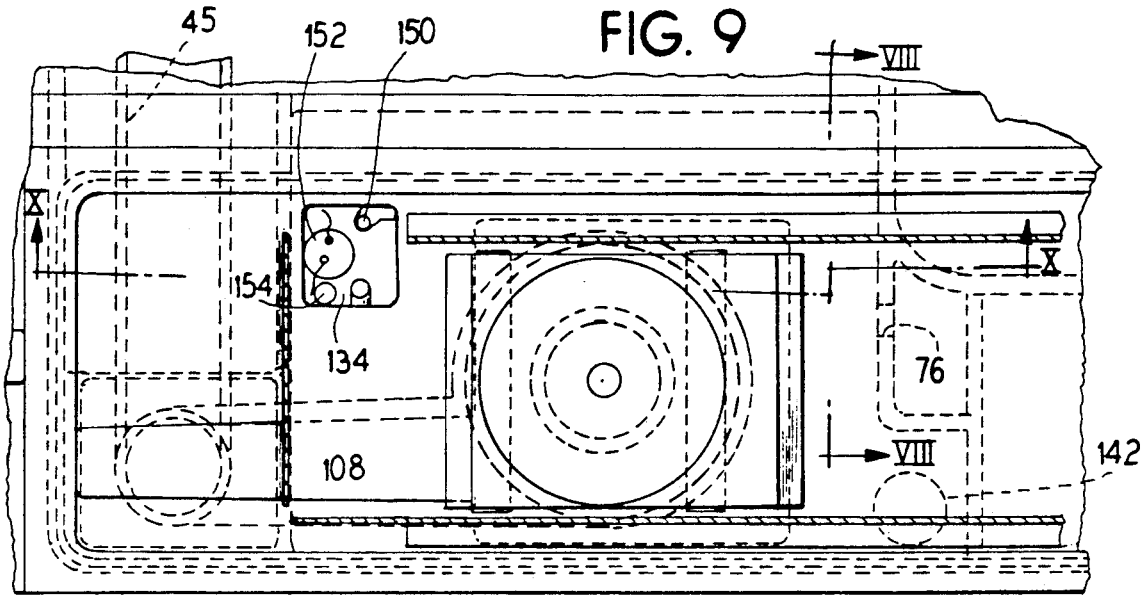
FIG. 9 is a top sectional view of the electrical module taken generally along the line IX—IX of FIG. 4.
Figure 10:
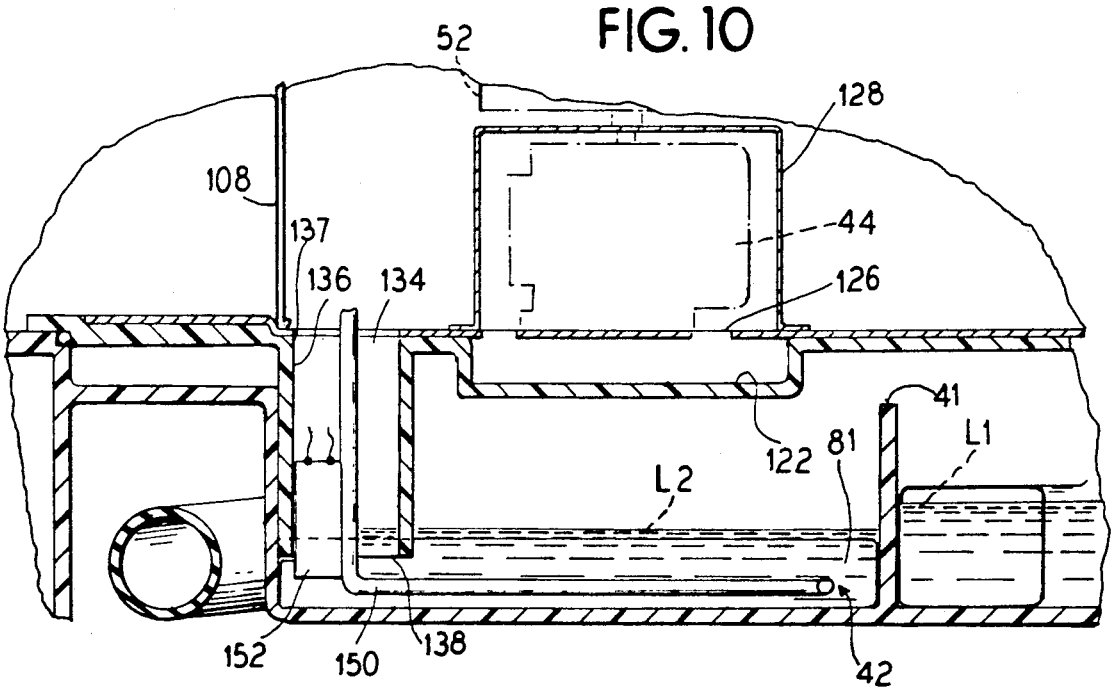
FIG. 10 is a side sectional view of the spray sump taken generally along the line X—X of FIG. 9.
Figure 11:
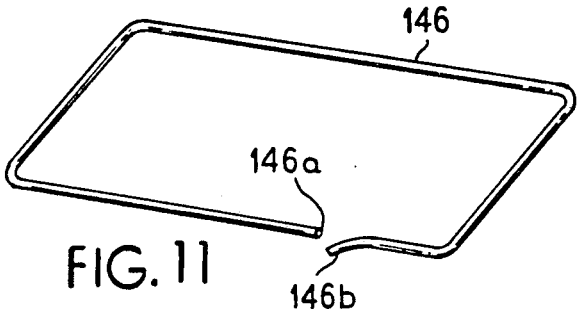
FIG. 11 is a perspective view of a sealing gasket.
Figure 12:
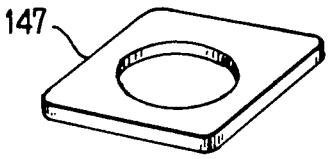
FIG. 12 is a perspective view of a seal member.

Two air outlets are provided for the pressurized air. A first outlet 132 is one or more small vent openings in the cover 108 leading back into the area enclosed by the dishwasher cabinet 12. A second outlet 134 (FIGS. 9, 10) leads to the washing chamber 16; however, this outlet is designed so that no air can flow through the washing compartment 16 when the machine is operating in a wash or rinse mode. This is accomplished by providing an air duct 136 having an inlet opening 137 open to the interior of the cover 108 and an outlet opening 138 open to the spray sump 42. The outlet opening 138 to the spray sump 42 is covered by wash (or rinse) liquid at level L2 or higher when the machine is in the wash (or rinse) mode of operation.

When the liquid is pumped out of the sumps 38, 42, the liquid level therein drops below the outlet opening 138, thus permitting air from the interior of the housing 108 to flow through the air duct 136. Since the outlet opening 138 provides a larger cross-sectional area for air flow than the first outlet 132, most of the air flow generated by the fan 52 passes through the air duct 136 and into the spray sump 42. From the spray sump 42, the air flows directly into the washing chamber 16 through the channel 48 and through the screen 72, thus drying the screen. Further, since the motor 44 that runs the fan 52 also runs the pump 43, air will be pumped through the spray arm 20 and will therefore dry out the interior of the spray arm.

Air control through the wash chamber 16 is needed since it is undesirable to have air flowing through the dishwasher during washing and rinsing. Excessive moisture and heat losses would occur should pressurized air be introduced into the wash cavity during the wash or rinse mode. When the machine is washing or rinsing, the spray pump fan 52 still provides cooling air for the pump motor 44. The air path through the wash chamber (drying air) presents significantly lower resistance to airflow than the vent openings in the cover 108; hence the air path through the wash chamber is the principal path used when the machine contains no wash liquid.

Figure 4:
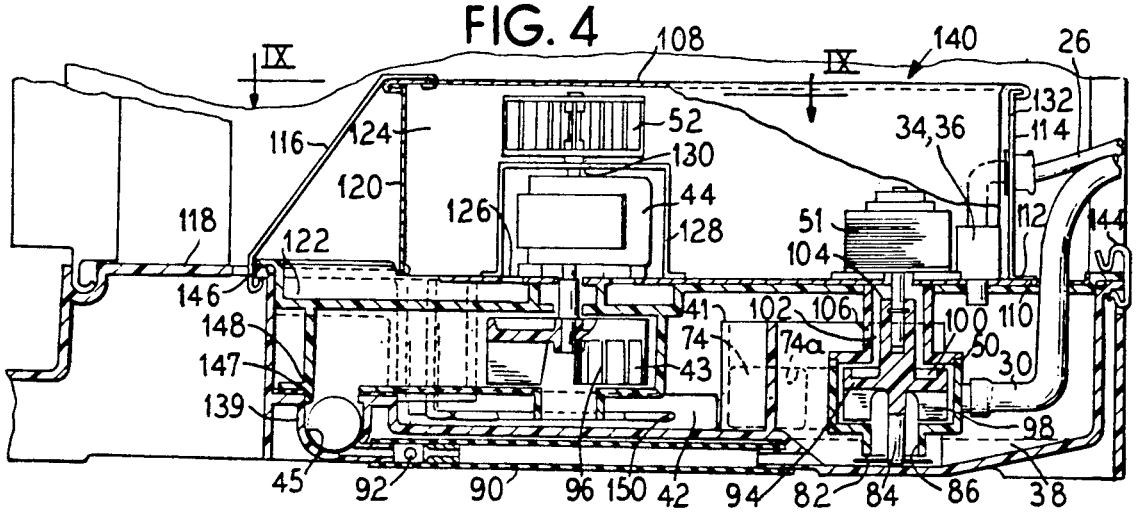
FIG. 4 is a side sectional view of the sumps and pumps area taken generally along the line IV—IV of FIG. 3.

In order to reduce manufacturing costs, the dishwasher may be constructed in a modular fashion with many of the structural components molded as a unit. For example, the washing compartment may be molded as a single unit. Also a molded base unit 139 may be provided which contains both the settling chamber/drain sump 38 and the spray sump 42 as well as the above described walls 75, 41. A power module 140 (carried on the subassembly base 110) may be provided which carries the drain pump 50 and its motor 51, the spray pump 43, its motor 44, and the fan 52, as well as other components such as an overfill protect float 142 (FIGS. 3 and 9) and fill valve 34 and vacuum break 36 (FIG. 4). The power module 140 can be assembled onto the base unit 120 by a minimum of fasteners, such as a clip 144 and the connecting rod 116 with a seal 146 being provided between the two units. A seal member 147 is also provided where an outlet 148 of the spray pump 43 joins the connecting conduit 45 leading to the spray arm 20.

The spray pump 43, located at the front of the power module 140, is centered in the spray sump 42 molded in the base unit 139. The pump 43 is surrounded by a tubular electrical heating element 150. The heating element 150 is formed in a simple geometric shape to heat fluid throughout the sump 42, and is carefully located so that it is spaced away from direct contact with any of the molded plastic parts of the system. In the exemplary embodiment, heating element power is 1200 watts and provides a temperature rise of about 3° fahrenheit per minute. The spray pump flow rate is approximately eight gallons per minute.

The control system may either be electronic or electromechanical. In the illustrated embodiment, the control is designed for a timed-fill with a float switch overfill protection. The control is designed to be a complete subassembly located at the dishwasher front to the right of the washing compartment 16. The control provides a temperature hold on selected parts of the cycle. A 140° fahrenheit temperature hold thermostat 152 is installed in the machine power module along with a second safety thermostat 154 that shuts off the water heater element 150 in the event of an over-temperature condition. The safety thermostat 154 operates independently of the control module.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a dishwasher having at least one wall defining a wash cavity, and a floor for draining soil-laden wash liquid from said wash cavity, said soil-laden wash liquid having suspended soil particles of varying sizes and varying specific gravities of more or less than one, a soil separator comprising:

a screen disposed in said floor for preventing passage therethrough of soil particles larger than a predetermined size;

a first sump for receiving one of two divided flow streams of said soil-laden wash liquid drained from said wash cavity through said screen;

a second sump for receiving a second of the two divided flow streams of said soil-laden wash liquid from said wash cavity including said soil particles whose passage into said first sump was prevented by said screen;

said second sump having a first baffle for deflecting said soil-laden wash liquid;

said second sump further including a separation chamber;

said separation chamber including a settling region permitting heavier-than-water soil particles to settle to the bottom of said separation chamber and lighter-than-water soil particles to float to the top of said soil-laden wash liquid in said chamber;

said settling region having an elevated dam extending into at least a portion of said soil-laden wash liquid for blocking flow of light solids; and said settling region further having weir means for preventing passage of heavier-than-water soil particles and permitting flow of cleansed wash liquid into said first sump, whereby both lighter-than-water and heavier-than-water soils are retained in said second sump.

2. A soil separator according to claim 1, wherein said weir means includes means for varying wash liquid flow rate from said separation chamber to said first sump in relation to the level of soil-laden wash liquid in said second sump.

3. A soil separator according to claim 2, wherein said weir means comprises a wall with a U-shaped notch therein between said first and second sumps, a bottom of said notch being positioned far enough above a floor of said second sump so as to prevent passage of heavier-than-water soils.

4. A soil separator according to claim 1, including means for preventing wash liquid from flowing from said first sump into said second sump.

5. A soil separator according to claim 1, wherein said screen means is angled toward said second sump to assist in directing said larger than a predetermined size particles into said second sump.

6. In a dishwasher having at least one wall defining a wash cavity and a floor for draining soil-laden wash liquid from said wash cavity, said soil-laden wash liquid having suspended soil particles of varying sizes and varying specific gravities of more or less than one, a soil separator comprising:

a first sump;

a second sump;

first channel means for directing a first flow stream into said first sump;

second channel means for directing a second flow stream into said second sump;

screen means for blocking the passage of soil particles larger than a predetermined size into said first channel means and directing said particles into said second channel means;

means in said second sump for reducing turbulence of said second flow stream;

dam means downstream of said turbulence reducing means for removing floating soil particles from said flow stream;

weir means downstream of said turbulence reducing means; and means for directing said flow stream to said first sump downstream of said weir means.

7. A soil separator according to claim 6, wherein said screen means is angled toward said second channel means to assist in directing said larger than a predetermined size particles into said second channel means.

8. A soil separator according to claim 6, wherein said screen means overlies and covers said first channel means.

9. A soil separator according to claim 6, wherein said dam means comprises a wall elevated above a floor of said second sump under which said second flow stream passes prior to being directed to said first sump.

10. A soil separator according to claim 6, wherein said dam means is positioned upstream of said weir means.

11. A soil separator according to claim 6, wherein said weir means comprises a wall extending upwardly from a floor of said second sump.

12. A soil separator according to claim 11, wherein said weir means comprises a wall separating said first sump from said second sump.

13. A soil separator according to claim 12, wherein said means for directing said flow stream to said first sump downstream of said weir means comprises a notch formed in said wall through which said second flow stream passes.

14. A soil separator according to claim 13, wherein a bottom of said notch is elevated above said floor of said sump.

15. A soil separator according to claim 13, wherein said notch is V-shaped such that as the liquid level in said second sump rises a greater rate of liquid flow passes through said notch.

16. A soil separator according to claim 6, wherein said turbulence reducing means comprises a baffle located in said second sump.

17. In a dishwasher having at least one wall defining a wash cavity and a floor for draining soil-laden wash liquid from said wash cavity, said soil-laden wash liquid having suspended soil particles of varying sizes and varying specific gravities of more or less than one, a soil separator comprising:

a first sump;

a second sump;

a first channel formed in said floor of said wash cavity for directing a first stream of wash liquid to said first sump;

a second channel formed in said floor of said wash cavity for directing a second flow stream of wash liquid to said second sump;

a screen overlying said first channel for blocking the passage of soil particles larger than a predetermined size into said first channel and directing said particles into said second channel;

a baffle in said second sump for reducing turbulence of said second flow stream;

a dam downstream of said baffle and being elevated above a floor of said second sump for removing floating soil particles from said flow stream;

weir downstream of said dam for removing heavier-than-water soil particles from said flow stream; and a V-shaped notch in said weir permitting passage of wash liquid from said second sump to said first sump.

18. A washer having a wall defining a chamber for receiving soiled articles to be cleansed, comprising:

pump means outside of said wash chamber for generating a recirculating flow of wash liquid into said wash chamber to remove soil particles from said articles;

inlet conduit means for directing wash liquid from said pump to said wash chamber and outlet conduit means for directing wash liquid from said wash chamber to said pump;

means in said outlet conduit for dividing said recirculating flow of wash liquid on its return to said pump means simultaneously into a relatively high volume flow stream and a relatively low volume flow stream;

diverting means in a path of said recirculating flow to direct large soil particles into said low volume flow stream;

separating means in said low volume flow stream for removing heavier-than-water and lighter-than-water soil particles from said low volume flow stream; and communication means for directing said low volume flow stream to said pump means, downstream from said separating means.

19. A washer according to claim 18, said diverting means comprises screen means for permitting passage of liquid therethrough, but preventing passage of large soil particles therethrough.

20. A washer according to claim 18, said separating means comprising an elevated dam positioned in said low volume flow stream to capture lighter-than-water soil particles, and a weir downstream of said elevated dam to capture heavier-than-water soil particles.

21. A washer according to claim 20, said communication means comprising a V-shaped notch in said weir, said weir comprising a wall separating said low volume flow stream from said pump means.

* * * * *